US006271624B1

(12) United States Patent
Taguchi et al.

(10) Patent No.: US 6,271,624 B1
(45) Date of Patent: Aug. 7, 2001

(54) CATHODE RAY TUBE HAVING A FAG WITH SPRING HOLDER

(75) Inventors: Hiromichi Taguchi; Kenichiro Takayanagi; Mitsuhiro Kawase, all of Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 08/121,365

(22) Filed: Sep. 15, 1993

(30) Foreign Application Priority Data

Sep. 17, 1992 (JP) ..... P04248051

(51) Int. Cl.[7] ..... H01J 29/07
(52) U.S. Cl. ..... 313/402; 313/404; 313/405
(58) Field of Search ..... 313/402, 403, 313/404, 405, 406, 407, 408

(56) References Cited

U.S. PATENT DOCUMENTS 4,455,505 * 6/1984 Ragland, Jr. ..... 313/407
4,547,695 * 10/1985 Rath ..... 313/406
4,827,180 * 5/1989 Sone et al. ..... 313/404
5,012,154 * 4/1991 Ragland, Jr. ..... 313/404 X
5,189,334 * 2/1993 Park ..... 313/407
5,247,224 * 9/1993 Bae ..... 313/404
5,410,215 * 4/1995 Seo ..... 313/407

FOREIGN PATENT DOCUMENTS

0276838 * 8/1988 (EP) .
0 325 207 A2 * 7/1989 (EP) ..... 313/402

* cited by examiner

*Primary Examiner*—Ashok Patel
(74) *Attorney, Agent, or Firm*—Sonnenschein Nath & Rosenthal

(57) ABSTRACT

A color selecting electrode of a cathode ray tube is prevented from being twisted to thereby suppress an electron beam from a mislanding. A metal thin plate (6) having vertically striped opening portions (6*a*) is supported by frame members (7*a*), (7*b*) under a proper tension. The frame member (7*a*) welded to the metal thin plate (6) is joined with a supporting member (8) extended in the longitudinal direction and the frame member (7*b*) welded to the frame member (7*a*) is joined with a supporting member (9) extended in the direction (Z-axis direction) perpendicular to a plane formed of the frame members (7*a*, 7*b*). The supporting member (9) is fixed to substantially a central portion of the frame member (7*b*).

2 Claims, 7 Drawing Sheets

CATHODE RAY TUBE HAVING A FAG WITH SPRING HOLDER

BACKGROUND OF THE INVENTION

1. Field of the Invention

The present invention generally relates to cathode ray tubes and, more particularly, is directed to a cathode ray tube (CRT) having a color selecting electrode with an opening for displaying a color image.

2. Description of the Related Art

FIG. 1 of the accompanying drawings shows a conventional cathode ray tube of this type.

As shown in FIG. 1, a panel 11, a funnel portion 12 and a neck portion 12*a*, each being made of glass, constitute a tube envelope. A color selecting electrode 13 (e.g., aperture grill or the like) is disposed on the inner surface of a skirt portion 11*a* of the panel 11, and an electron gun 18 is disposed within the neck portion 12*a*.

As shown in FIG. 2, the color selecting electrode 13 comprises a metal thin plate 14 having vertical stripe-shaped opening portions 14*a* to serve as a grid and a metal frame 15 (15*a*, 15*b*) for giving a proper tension to the metal thin plate 14.

To the frame members 15*a*, 15*b* are secured springs 16*b* of long plate shape through holders 16*a* as supporting members 16. The color selecting electrode 13 are supported at four points by the engagement between apertures 16*c* of the spring 16*b* and pins 17 of the panel 11. In FIG. 2, reference numerals 20 designate bimetal members for correcting a so-called mislanding of an electron beam due to a thermal expansion of the color selecting electrode 13.

In the example of the conventional cathode ray tube, the springs 16*b* are fixed to the opposing frame members 15*a*, 15*b* in the opposite directions so that the color selecting electrode 13 is twisted due to various factors. As a consequence, a so-called landing twist occurs in an electron beam emitted from the electron gun 18.

OBJECTS AND SUMMARY OF THE INVENTION

In view of the aforesaid aspects, it is an object of the present invention to provide an improved cathode ray tube in which the aforesaid shortcomings and disadvantages encountered with the related art can be eliminated.

More specifically, it is an object of the present invention to provide a cathode ray tube in which a color selecting electrode can be prevented from being twisted so that a deviation of an electron beam can be suppressed considerably.

According to an aspect of the present invention, there is provided a cathode ray tube which comprises a face plate panel having a plurality of pins, a frame, a color selecting electrode mounted on said frame, and a plurality of supporting members being engaged with said pins, and joining with said frame at least opposed two of said supporting members joining perpendicular to the plane of said frame plate panel.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

A cathode ray tube according to the present invention will hereinafter be described with reference to the drawings.

Figure 4:
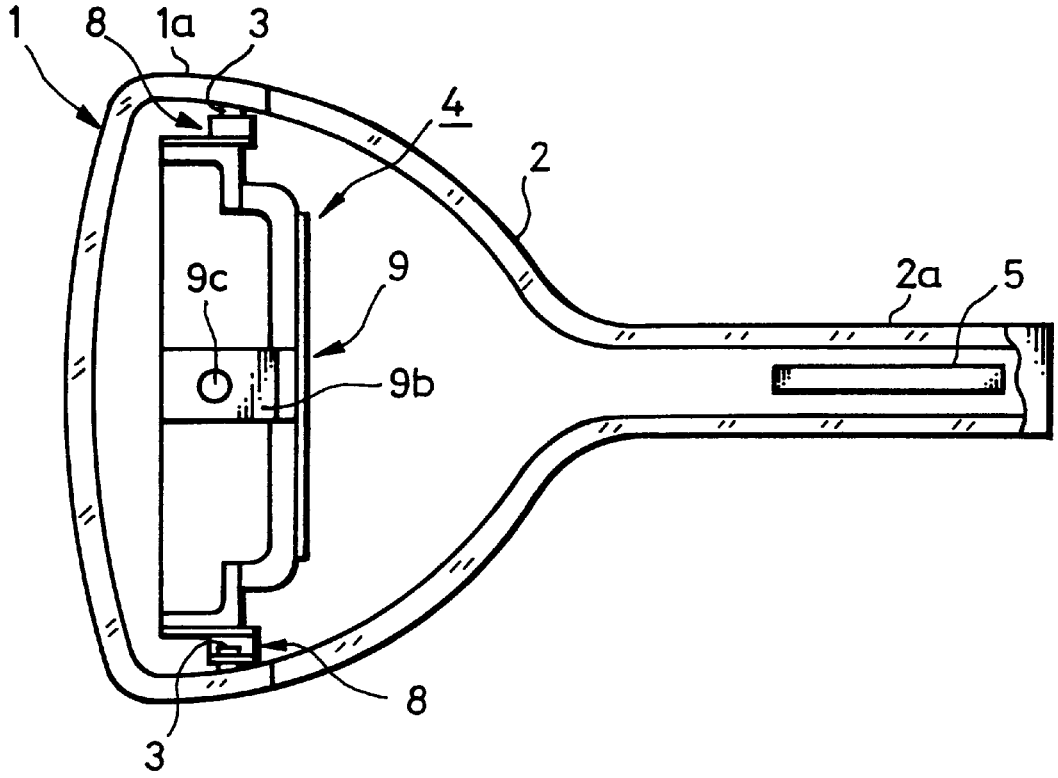
FIG. 4 is a diagram showing an overall arrangement of the cathode ray tube according to the first embodiment of the present invention.

FIG. 4 is a diagram showing an overall arrangement of a cathode ray tube according to a first embodiment of the present invention. As shown in FIG. 4, a tube envelope is formed by frit-sealing a panel 1 and a funnel portion 2, each being made of glass. Panel pins 3 are formed on respective inner surfaces of a skirt portion 11*a* of the panel 1 and a color selecting electrode 4 is supported to these panel pins 3 according to a method which will be described later. An electron gun 5 is disposed within the neck portion 2*a* of the funnel portion 2.

Figure 3A:
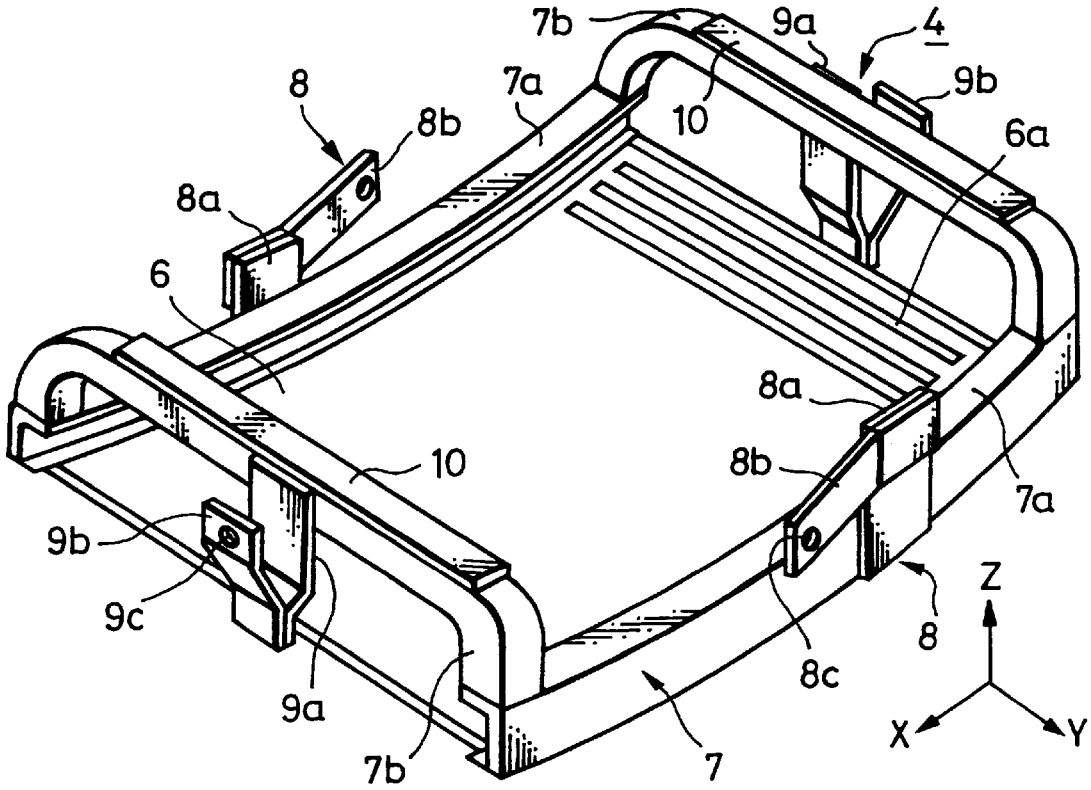
FIG. 3A is a perspective view showing a color selecting electrode of a cathode ray tube according to a first embodiment of the present invention.

FIG. 3A shows the color selecting electrode 4 according to the embodiment of the present invention. As shown in FIG. 3A, the color selecting electrode 4 comprises a metal thin plate 6 having vertical stripe-shaped openings 6*a* serving as a grid for allowing an electron beam to pass therethrough and a metal frame 7 (7*a*, 7*b*) for applying a proper tension to the metal thin plate 6.

The metal frame 7 is a square frame formed of a pair of opposing supporting frame members 7*a* and a pair of resilient frame members 7*b* of U-configuration secured across respective ends of the pair of frame members 7*a*. The metal thin frame 6 is welded at its respective ends of side edge portions of the opening portions 6*a* to the two frame members 7*a* and then stretched therebetween. Bimetal members 10 are provided on the frame members 7*b* so as to correct the mislanding of electron beam due to a thermal expansion of the color selecting electrode 4.

The frame members 7*a* are each joined with a supporting member 8 similar to the example of the related art, i.e., each frame member 7*a* is joined at its substantially central portion of an outside portion with a long plate-shaped spring 8*b* through a holder 8*a* by welding. These springs 8*b* are made of stainless steel and attached to the frame members 7*a* along the same direction (X-axis direction) of the frame members 7*a*. Each spring 8*b* has formed therethrough a hole 8*c* that is in engagement with the panel pin 3 formed on the panel 1.

Figure 3B:
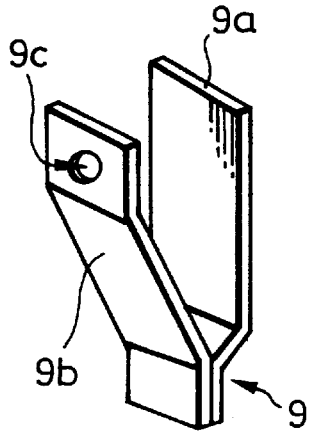
FIG. 3B is a perspective view showing a supporting member of the cathode ray tube according to the first embodiment of the present invention.

The frame members 7*b* perpendicular to the frame members 7*a* are each joined with a supporting member 9 extending in the direction (Z-axis direction: tube axis direction) perpendicular to the plane formed by the frame members 7*a*. As shown in FIG. 3B, each of the supporting members 9 comprises a plate-shaped holder 9*a* and a plate-shaped spring 9*b*. One ends of the holder 9*a* and of the spring 9*b* are fixed together by welding. Each spring 9*b* has formed therethrough a hole 9*c* that is in engagement with the panel pin 3 formed on the panel 1. The spring 9*b* is bent at its portion of the hole 9*c* in substantially parallel to the holder 9*a*. The spring 9*b* and the holder 9*a* are both made of stainless steel.

Figure 3C:
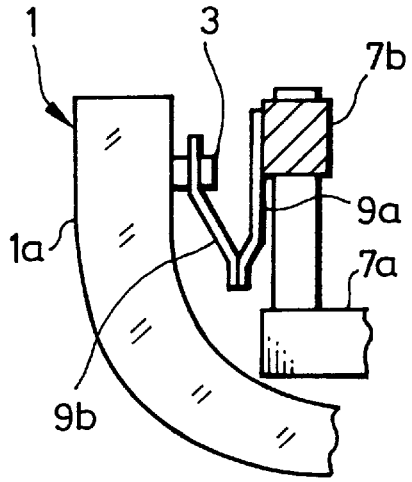
FIG. 3C is a fragmentary cross-sectional view of the supporting member of the cathode ray tube according to the first embodiment of the present invention.

The holder 9*a* is joined at its portion where the spring 9*b* is not welded with the outside portion of each frame member 7*b* by welding. In this case, the frame member 7*b* and the holder 9*a* are fixed together at an angle of 90°. Further, as shown in FIG. 3C, the color selecting electrode 4 is attached to the panel 1 by fitting the holes 9*c* of the springs 9*b* into the panel pins 3.

Figure 5A:
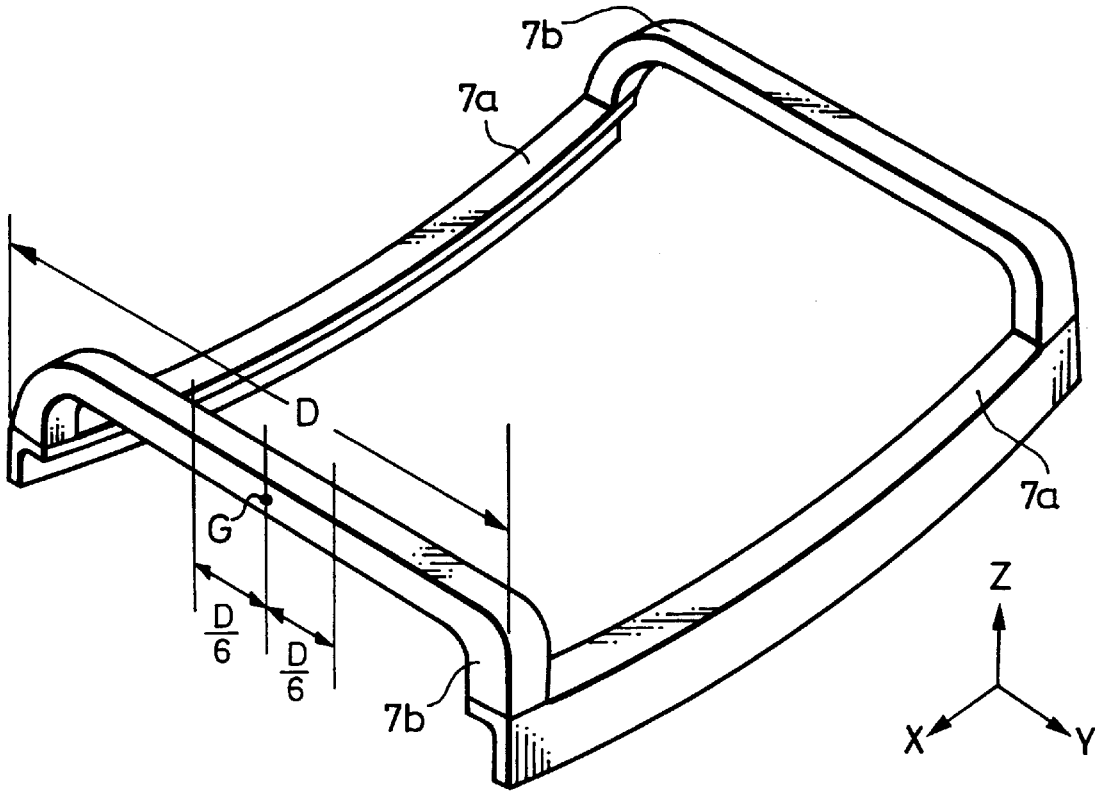
FIGS. 5A and 5B are diagrams used to explain the fixed position of the supporting member of the cathode ray tube according to the first embodiment of the present invention, respectively.
Figure 5B:
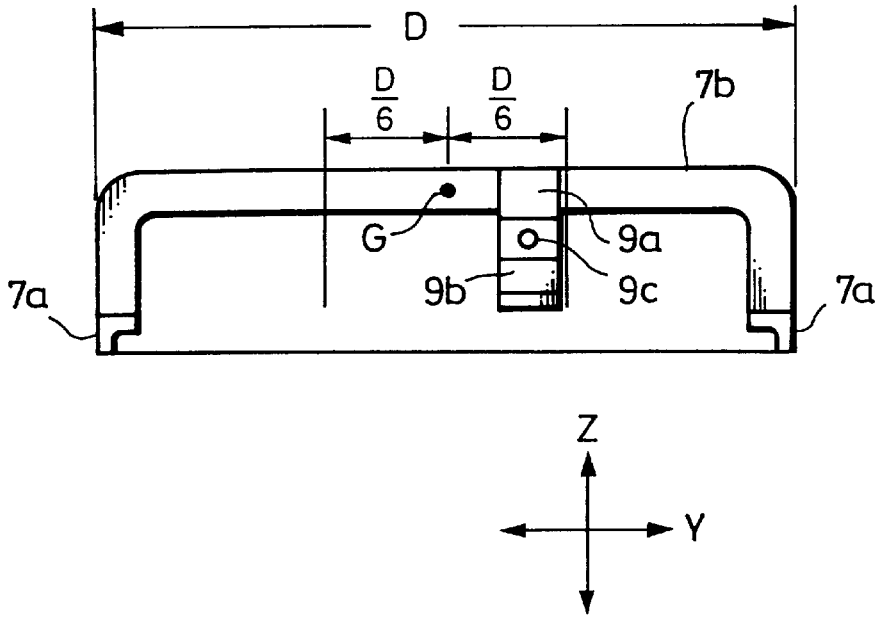

As shown in FIGS. 5A and 5B, the position at which the supporting member 9 is fixed to the frame member 7*b* is determined such that, when the length of the frame member 7*b* is set to be D, the hole 9*c* of the spring 9*b* is provided within a range of D/6 from a middle point G of the frame member 7*b*. If the aforesaid position is provided within this range, then the supporting member 9 may be deviated either in the positive or negative direction of the Y axis. Also, the opposing supporting members 9 may be deviated in the different directions. It is preferable that the position of the hole 9*c* of the spring 9*b* is selected to be nearer to the middle point G of the frame member 7*b*.

In the cathode ray tube thus arranged according to the embodiment of the present invention, since the supporting member 9 extending in the direction perpendicular to the plane formed by the frame 7 is used and the color selecting electrode 4 is supported near the middle point of each of the frame members 7*b*, the frame members 7*b* are equally applied with a tension so that the color selecting electrode 4 is supported in a well-balanced condition, thereby making the frame 7 and the metal thin plate 6 difficult to be twisted. Therefore, according to this embodiment, it becomes possible to prevent the landing twist, i.e., the electron beam from being mis-landed.

The landing condition, i.e., the deviation of the electron beam had been examined by using the cathode ray tube of the first embodiment of the present invention. In that case, a cathode ray tube of 29-inch was used and a green beam was used as an electron beam. An initial drift (0 to 5 minutes) also was investigated at nine points of the center and peripheral portion of the picture screen. Measured results are illustrated in FIG. 6.

Figure 6:
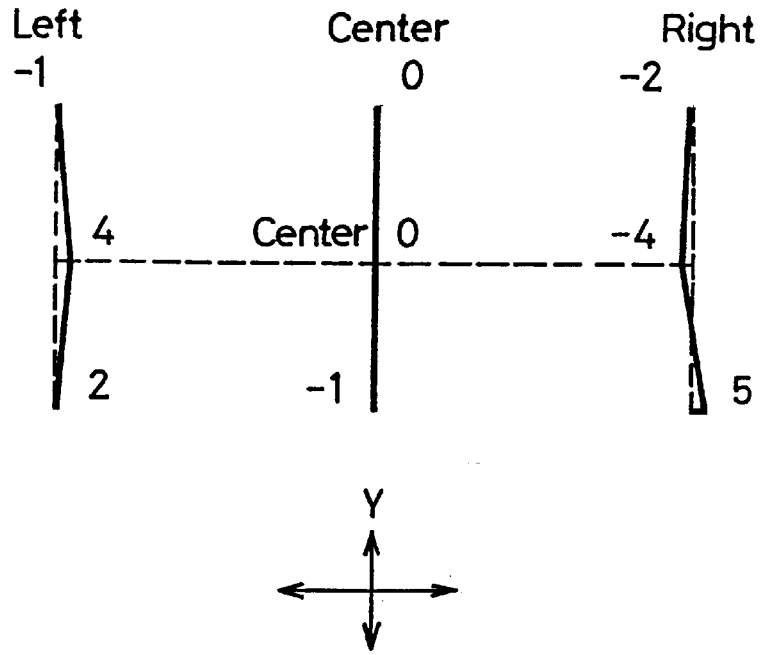
FIG. 6 is a diagram used to explain the landing twist condition in the first embodiment of the present invention.

Study of FIG. 6 reveals that the landing twist can be removed considerably according to the cathode ray tube of the first embodiment.

Figure 1:
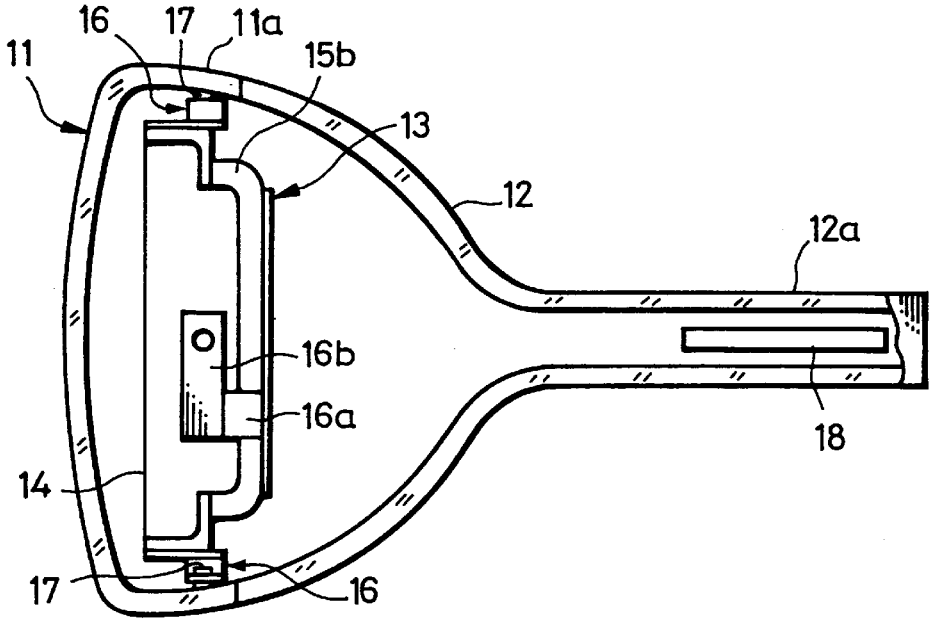
FIG. 1 (PRIOR ART)
FIG. 1 is a diagram showing an overall arrangement of a conventional cathode ray tube.
Figure 2:
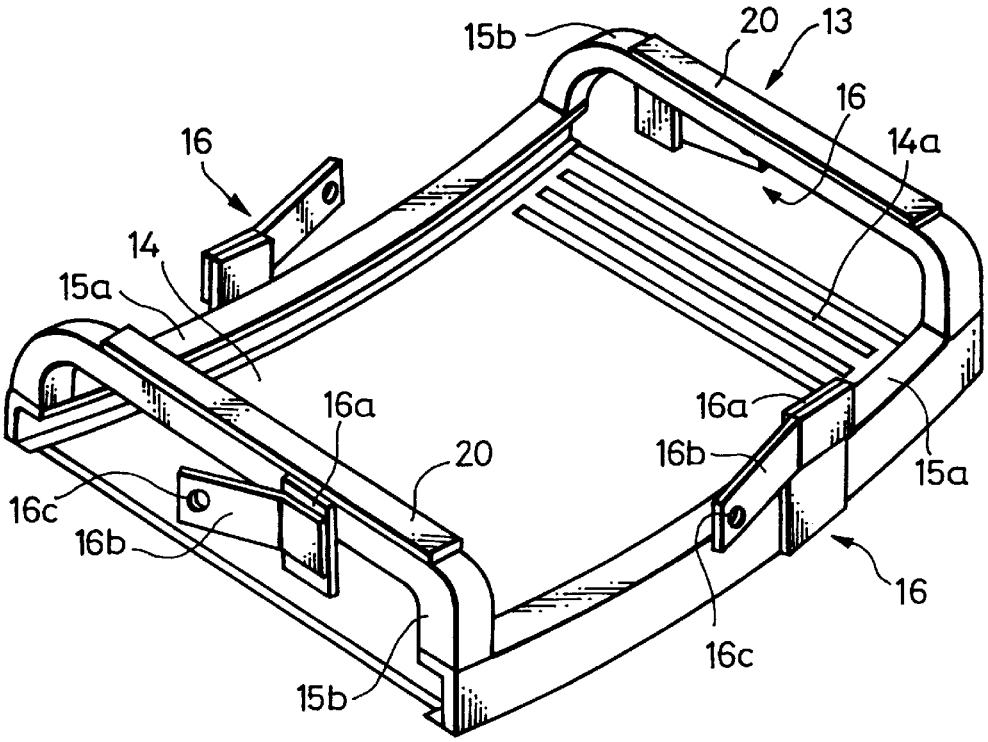
FIG. 2 (PRIOR ART)
FIG. 2 is a perspective view showing a color selecting electrode of the conventional cathode ray tube shown in FIG. 1.

As a comparative example, the landing state was examined by using the conventional cathode ray tube having the arrangement according to the example shown in FIG. 2. In that case, the measuring conditions were similar to those of the above first embodiment. Measured results are shown in FIG. 7.

Figure 7:
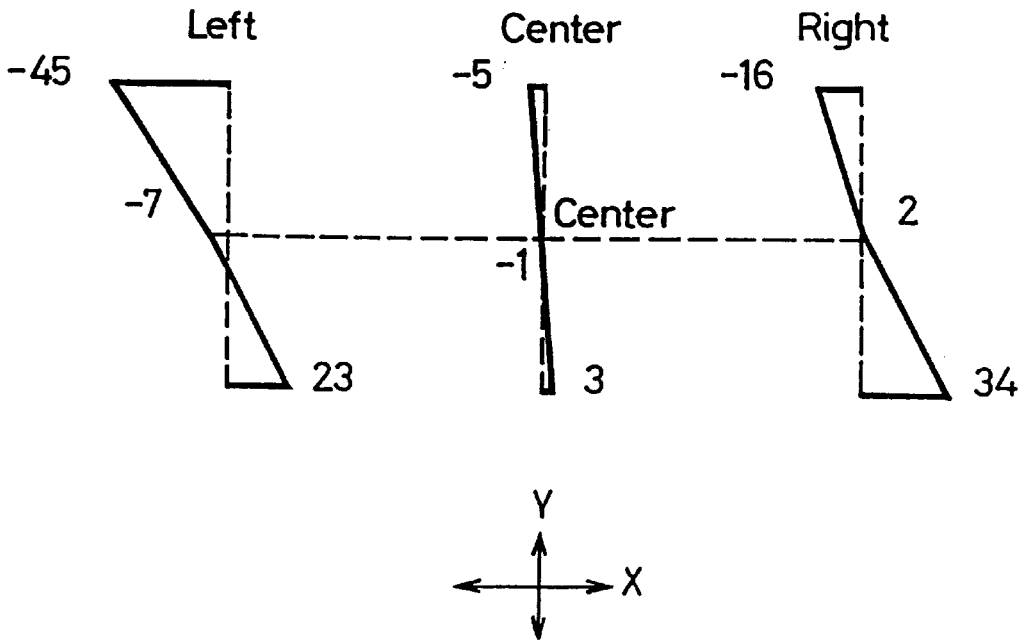
FIG. 7 is a diagram used to explain the landing twist condition in a comparative example.

Study of FIG. 7 reveals that the landing twist takes place considerably in the arrangement of the conventional cathode ray tube.

While the spring and the holder are joined with each other by welding as the supporting member as described above, the present invention is not limited thereto and a supporting member in which a spring and a holder are integrally formed may be employed.

While the welded portion of the spring and the holder is secured in the direction to the metal thin plate as described above, the present invention is not limited thereto and the welded portion of the spring and the holder may be fixed in the opposite direction (upper direction in FIGS. 3B and 3C). Further, the fixing angle is not limited to the right angle to the plane formed by the frame and may be inclined a little so long as the welded portion is placed in the direction intersecting the above-mentioned plane. In this case, if the angle is made closer to the right angle, then the landing twist can be avoided more effectively.

Figure 8A:
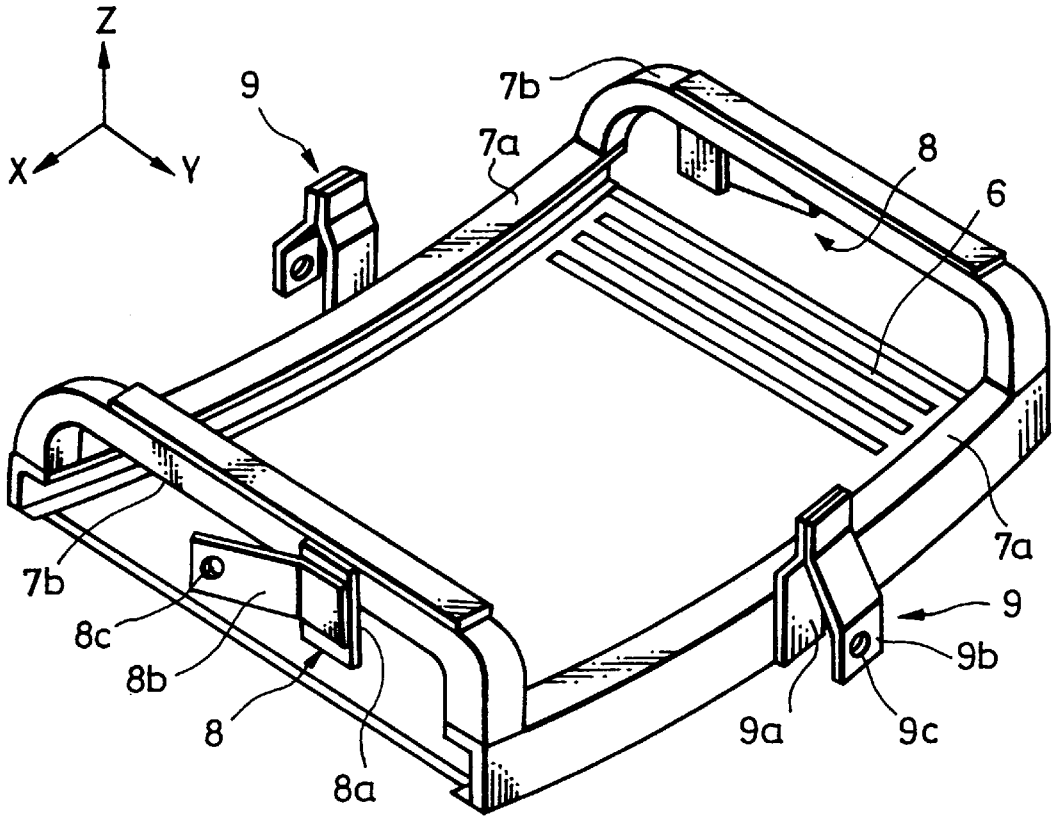
FIG. 8A is a perspective view showing a color selecting electrode of a cathode ray tube according to a second embodiment of the present invention.
Figure 8B:
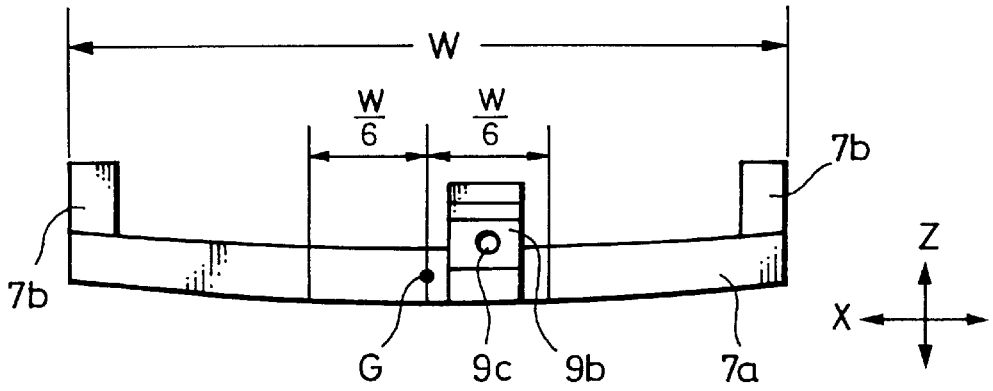
FIG. 8B is a diagram used to explain the fixing position of the supporting member in the second embodiment of the present invention.

FIGS. 8A, 8B show a main portion of a second embodiment of the cathode ray tube according to the present invention. In the second embodiment, like parts corresponding to those of the first embodiment are marked with the same references.

According to the second embodiment of the present invention, the supporting member 9 having the arrangement similar to that of the first embodiment is fixed to the outside portion of the frame member 7*a*. In this case, the supporting member 9 is fixed to the frame member 7*a* by welding while the welding portion of the spring 9*b* and the holder 9*a* is directed upwardly, i.e., in the Z-axis direction of FIG. 8A. As shown in FIG. 8B, when the length of the frame member 7*a* is set to be W, it is preferable that the position at which the supporting member 9 is fixed to the frame member 7*a* is selected such that the hole 9*c* is provided within a range of W/6 from the middle point G of the frame member 7*a*.

The frame members 7*b* perpendicular to the frame members 7*a* are joined with the supporting members 8 extending in the Y-axis direction similar to the related-art example by welding in the opposite directions to each other. According to the arrangement of the cathode ray tube of the second embodiment, the landing twist can be avoided effectively. A rest of arrangement and action is similar to that of the first embodiment and therefore need not be described.

Figure 9:
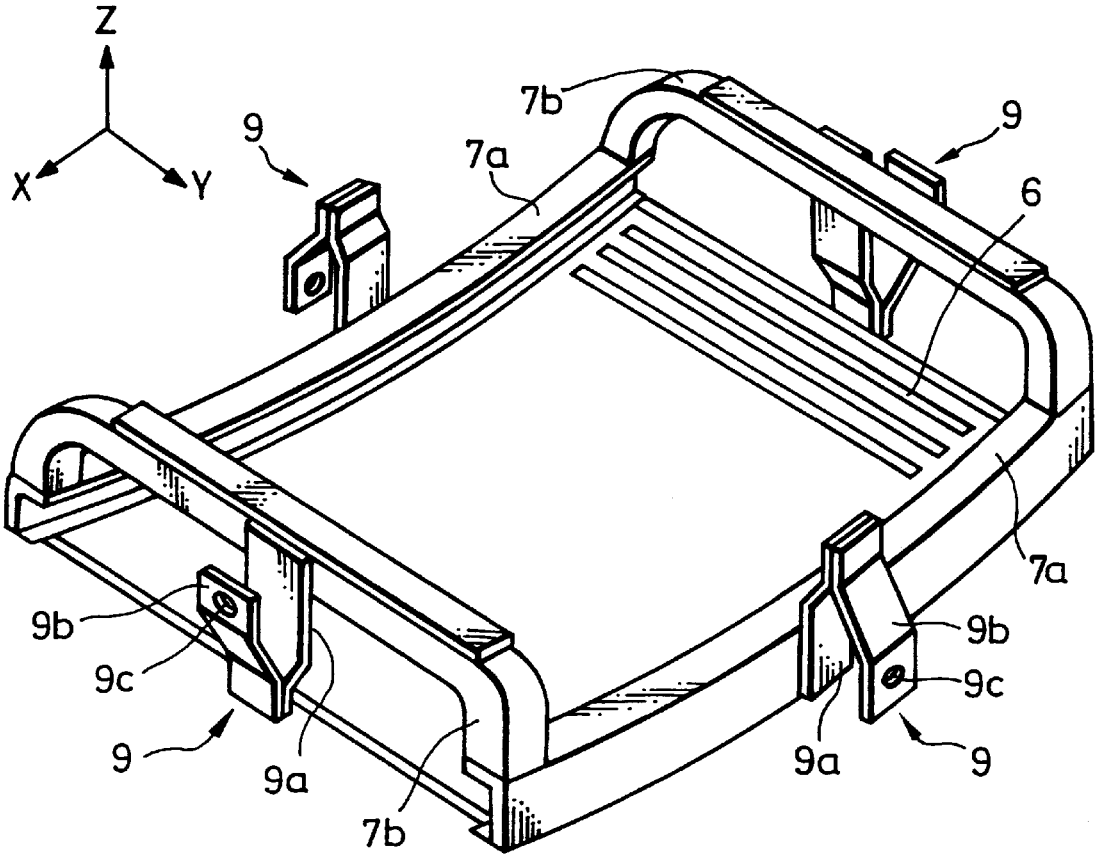
FIG. 9 is a perspective view showing a color selecting electrode of a cathode ray tube according to a third embodiment of the present invention.

FIG. 9 shows a main portion of a third embodiment of a cathode ray tube according to the present invention. In the third embodiment, parts and elements identical to those of the first and second embodiments are marked with the same references.

According to the third embodiment of the present invention, all the frames 7*a*, 7*b* are joined with the supporting members 9 extending in the Z-axis direction. The place and method of fixing the supporting members 9 to the frames 7*a*, 7*b* are similar to those of the first and second embodiments. According to the third embodiment of the present invention, the landing twist can be prevented most effectively. A rest of arrangement and action is the same as those of the first and second embodiments and therefore need not be described.

While the metal thin plate having vertical stripe-shaped opening portions is the aperture grill as described above, the present invention is not limited thereto and can be applied to the case that the metal thin plate is a so-called shadow mask having dot-shaped opening portions.

As set out above, according to the present invention, since the color selecting electrode is supported by the members in which the supporting members extending in the direction perpendicular to the plane formed by the frame supporting the thin plate, particularly, the members formed by integrally coupling the holders and the springs having the holes in the opposing direction and these supporting members are secured near the central portions of respective sides of the frame, the color selecting electrode can be prevented from being twisted and a deviation of the electron beam can be suppressed considerably.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A cathode ray tube comprising:

a) a planar face plate panel having a plurality of pins;

b) a rectangular frame having four side members;

c) a color selecting electrode mounted on said frame; and d) four supporting members being engaged with said pins, each supporting member comprising a holder portion and a spring portion; each supporting member joining a central portion of one of said side members of said frame, at least two opposed spring portions of said supporting members extending away from said frame in a direction perpendicular to the plane of said face plate panel, wherein the distance between the middle point of said side member of said frame and a point where said supporting member is joined with said frame is less than one-sixth of such side frame.

2. A cathode ray tube comprising:

a) a planar plate panel having a plurality of pins;

b) a rectangular frame having four side members;

c) a color selecting electrode mounted on said frame; and d) four supporting members being engaged with said pins, each supporting member comprising a holder portion and a spring portion, and each supporting member joining with said frame, at least two opposed spring portions of said supporting members extending away from said frame in a direction perpendicular to the plane of said plate panel, wherein said supporting members are provided at the middle point of each of said four sides of said frame.

* * * * *